United States Patent [19]

Cleevely

[11] Patent Number: 4,494,679

[45] Date of Patent: Jan. 22, 1985

[54] THERMOPLASTIC CONTAINER CLOSURE FOR DISPENSING SOLIDS

[75] Inventor: Bruce T. Cleevely, Pittsburgh, Pa.

[73] Assignee: The C. F. Sauer Company, Richmond, Va.

[21] Appl. No.: 402,159

[22] Filed: Jul. 26, 1982

[51] Int. Cl.[3] ..... B65D 47/08

[52] U.S. Cl. ..... 222/151; 222/480; 222/545; 222/556; 220/254; 220/339; D9/366

[58] Field of Search ..... 222/480, 484, 485, 545, 222/556, 565, 151, 544, 196.1, 196.5, 149; 220/254, 337, 339; D9/366, 440

[56] References Cited

U.S. PATENT DOCUMENTS

| | | | |
|---|---|---|---|
| 2,758,753 | 8/1956 | Thiele | 222/151 |
| 3,140,019 | 7/1964 | Barr . | |
| 3,493,150 | 2/1970 | Lucas et al. | 222/480 |
| 3,499,588 | 3/1970 | Bartilson et al. . | |
| 3,675,812 | 7/1972 | Foster | 222/565 |
| 3,836,056 | 9/1974 | Pehr . | |
| 3,966,080 | 6/1976 | Bittel . | |
| 4,106,672 | 8/1978 | Tecco . | |
| 4,209,100 | 6/1980 | Uhlig . | |
| 4,223,814 | 9/1980 | Sneider . | |
| 4,358,032 | 11/1982 | Libit | 222/556 |

FOREIGN PATENT DOCUMENTS

| | | | |
|---|---|---|---|
| 2041891 | 9/1980 | United Kingdom | 222/556 |

*Primary Examiner*—H. Grant Skaggs

*Attorney, Agent, or Firm*—Parmelee, Miller, Welsh & Kratz, Jr.

[57] ABSTRACT

A thermoplastic container closure having a base with an open central area and a peripheral skirt depending from its outer edge for fitting about and attachment to the upper end of a container has an upstanding annular wall about the open center which supports a raised platform thereon which forms a first planar surface parallel to the base, with the platform having apertures therethrough and a shoulder at one end, and a closure flap hingedly attached to the shoulder, the flap having projections matable with the apertures in the platform such that when the flap is closed, the closure flap and shoulder form a second planar surface substantially parallel to both the platform and the base.

3 Claims, 6 Drawing Figures

THERMOPLASTIC CONTAINER CLOSURE FOR DISPENSING SOLIDS

BACKGROUND OF THE INVENTION

The present invention is for a container closure which, when affixed to a container that holds finely divided solid material, will selectively provide a clean and sanitary closure and a convenient dispensing means for the contents of the container. The closure is easy to mold from thermoplastic material, and is an integral unit. It is unique because it is devoid of any ridges or recessed areas on the container top surface, so that when it is applied to a container the assembly has no areas for the collection of dust or fine solid particles.

Numerous plastic closures are found in the art which can be used in dispensing solid material. Examples of such prior art plastic closures are illustrated in U.S. Pat. Nos. 3,140,019; 3,493,150; 3,499,588; 3,836,056; 3,966,080; 4,106,672; 4,209,100 and 4,223,814. As will be seen by reviewing these prior art references, they all have some type of recessed portion in the container top surface within which a hinged closure flap is seated, or some type of recessed walled area, which recessed portion or walled area will, over a period of time serve as a collection point for dust or other unwanted fine solid particles. Even in closure, such as described in U.S. Pat. No. 3,675,812 where a raised portion is provided on the container top, various walls are provided, either on the closure flap or on the container top surface with which the flap mates, which serve to collect dust or the like.

In the present thermoplastic container closure, only raised surfaces are provided along the top of the closure, so that the tendency to accumulate dust in recessed areas which is difficult to remove is obviated.

BRIEF SUMMARY OF THE INVENTION

A thermoplastic container closure, for use in dispensing finely divided solid material from a container to which the closure is secured, comprises an annular substantially planar base with a downwardly extending substantially cylindrical wall, the wall having attachment means such as a thread for attachment to a container with a neck, the rim of which seals against and supports the underside of the annular base, the base having a raised platform thereon which forms a first planar surface parallel to the base, which platform has at least one dispensing aperture therethrough and an upstanding shoulder at one end thereof, and a closure flap hingedly attached to the shoulder, which flap has at least one projection frictionally engageable within the apertures in the platform, such that when the flap is closed, with the projections frictionally engaged within the apertures, the closure flap and upstanding shoulder form a second planar surface which is substantially parallel to both the platform and the base.

BRIEF DESCRIPTION OF THE DRAWINGS

The present invention will be more fully understood by reference to the accompanying drawings, wherein.

DETAILED DESCRIPTION

Figure 1:
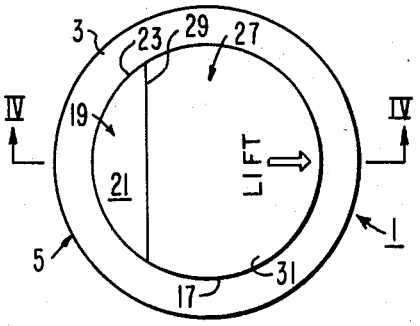
FIG. 1 is a top plan view of the container closure of the present invention with the flap in closed position.
Figure 2:
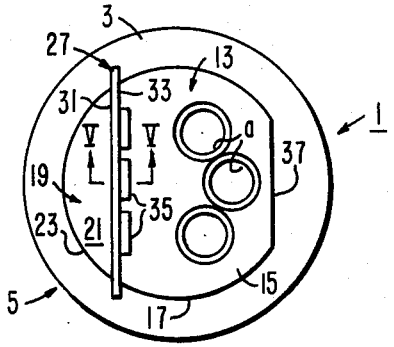
FIG. 2 is a top plan view of the container closure of FIG. 1 with the closure flap in open position.
Figure 3:
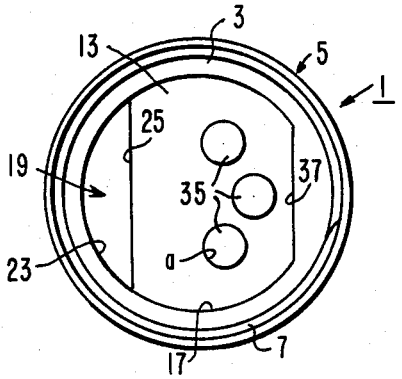
FIG. 3 is a bottom view of the container closure of FIG. 1 with the flap in closed position.
Figure 4:
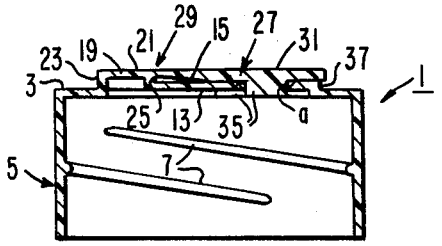
FIG. 4 is a cross-section taken along the lines IV—IV of FIG. 1.
Figure 5:
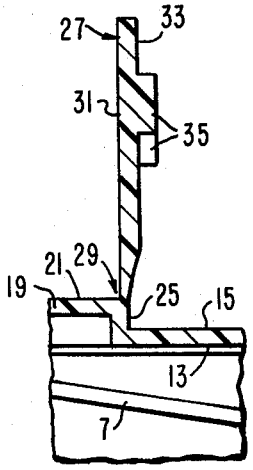
FIG. 5 is an enlarged cross-sectional fragmentary view taken along the lines V—V of FIG. 2, showing the hinge area of the container of the present invention with the flap in open position as in FIG. 2.
Figure 6:
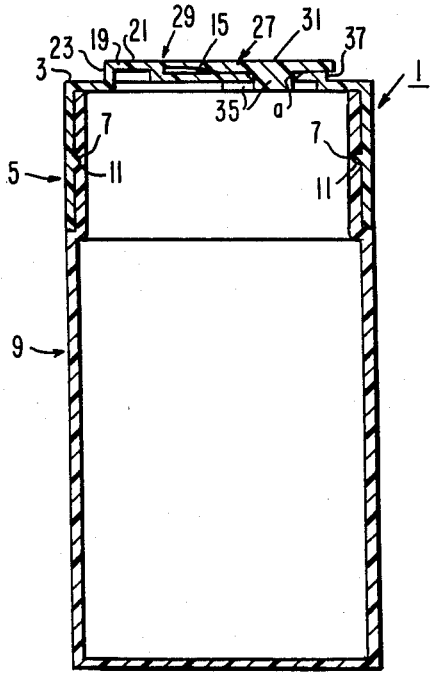
FIG. 6 is a cross-sectional view of the container closure, as in FIG. 1, engaged with a container.

Referring now to the drawings, FIG. 1 illustrates a top plan view of the integral, releasable, thermoplastic container closure 1 of the present invention having a substantially planar circular base 3 with a downwardly extending wall 5 about its periphery, sometimes referred to as a "skirt". As illustrated in FIG. 4, the downwardly extending wall 5 have attachment means, such as a thread 7 on the inner surface thereof, to releasably attach the container closure to a container 9. Although a thread 7 is illustrated in the drawings, for use with a container 9 having a cooperating thread 11 on the neck thereof, it is to be understood that the downwardly extending walls may have other attachment means, such as a groove which would frictionally engage a rib on the container neck, or other frictional attachment means known in the art. When the cap is applied tightly in place on the container, the neck of a bottle or jar to which it is applied is encircled by said depending skirt and the lip of the container neck forms a seal against and support for the undersurface of the base 3 within the circumference of the base 3 and said depending wall.

The circular base 3 has a raised platform 13 thereon, which platform 13 comprises a first elevated planar surface 15. This first planar surface, sometimes herein also referred to as the "lower elevated area" is in a plane parallel with the base. The platform is supported on the base by a vertical wall or flange 17 that extends completely around the inner periphery of the base. This first platform has at least one product dispensing aperture a therethrough, and usually there will be a group, three being shown in the drawing, but the size and number may vary. They may sometimes be termined "sifter openings". They are simply clean holes through the thickness of the platform with no upstanding ridge or depending skirt above or below the plane of the platform.

Extending across the raised area 15 in the position of a chord of the base circle there is an integral riser or step 25 dividing said raised areas 13 into said lower elevated area or first platform and a higher elevated area or shoulder 19 forming a second platform 21, the higher curved boundary 23 of which is an integral part of the circular vertical wall 17. A diameter that bisects this step into equal halves would, of course, be at right angle to the chord of the circle defined by the step 25 and this diameter would bisect the center opening a in a group of such openings, establishing the location of this and the other openings in the lower elevated area 15 in that portion of the platform which is furthest removed from the step 25. The upstanding shoulder 19 has an outer wall 23 which is complementary with the wall 17 of the raised platform 13, and an inner wall 25. Hinged to the upstanding shoulder 19 is a closure flap 27. The closure flap 27 is hingedly attached to the upstanding shoulder along the upper edge of the wall 25, by a hinge 29 that is formed by thinning to a flexible membrance the edge of the flap 27 along the connection thereof with the upstanding shoulder 19. The closure flap has a substantially planar upper surface 31 and a lower surface 33, the lower surface 33 having at least one projection 35 thereon, which projections mate with the apertures a in the platform 13 when the flap is in closed position. The upper edges of the apertures a may be bevelled and the projection 35 shaped so as to frictionally engage the walls about the apertures a to provide a force fit to frictionally but releasably retain the flap 27 in closed position. The apertures a and the projections 35 are preferably all located respectively in the first raised area 15 and remote from the hinge at the step 25, that is in an area diametrically across from and physically remote from the higher surface 21. At this location the arc of travel of the projections will more closely approach parallelism with the axes of the several holes as they approach a closing position than if they were closer to the hinge and therefore moving in a sharper curve. This location also enables the flap 27, when closed, to constitute a continuous planar surface with the higher level of surface 21 and avoid any crevice. The hinge line shown in the drawing, FIG. 1, is actually a concealed unbroken surface showing at most a crease line. When the flap 27 is fully closed, its undersurface, except where the projections pass through the sifter holes, is in full face-to-face contact in a plane parallel with the base.

With the flap 27 in closed position, the projections 35 being frictionally engaged to seal the apertures a, the upper surface of the closure 1 is comprised of only two parallelly planar surfaces, the first surface comprising the substantially planar base 3, and the second or raised surface comprising the planar surface 21 of the raised shoulder 19, and coplanar surface, the planar surface 31 of the flap 27.

Preferably, the container closure of the present invention, as illustrated in the drawings, is a cylindrical-shaped closure, with the upper surfaces thereof forming concentric circles. The edge of the platform 13 opposite the shoulder 19 is preferrably indented as at 37, so as to enable the user to reach under the flap 27 to readily raise the flap 27 and dispense the contents of the container through the apertures a.

The container closure of the present invention thus provides raised surfaces which are on parallel planes so as to prevent accumulation of dust. In addition, the planar surfaces enable easy and secure stacking of the container closures alone, or when secured to containers, one container having a closure upon another container with its closure that is, end-on-end, for shipment or storage. While the closure flap 27 may open and close quite easily, it should not open spontaneously. Because of this, there is a natural tendency for the user to press down on the flap with much greater force than necessary. Since the cap is formed of thermoplastic resin, it possesses flexibility that thermosetting resins do not have. It is not feasible in this or like products to increase the thickness of the thermoplastic resins to materially increase their rigidity. Not only are the closures subject to pressures as above pointed out, but they also are subject to stacking when the containers are filled and are being shipped or are in storage. By having the base of the closures supported directly on the lip of the vessel, destructive leverage tending to distort or rupture the base of the closure is reduced. Also, by all horizontal surfaces being parallel and at right angles to the axis of the closure, downward pressures are uniformly transmitted to the base, and to the lip of the container especially, by vertical walls in a generally columnar direction. Moreover, that central area of the closure which is pushing down on the flap and is farthest from the rim is reinforced by the double thickness of the flap and lower elevated area in face-to-face contact.

I claim:

1. A product dispensing closure for containers for finely divided solids wherein the container has a neck of circular section terminating in an annular lip, the closure comprising an integral thermoplastic molded unit having:

(a) an annular planar base having a depending skirt around its outer periphery which fits about and is secured to the neck of the container, with the lip sealed against and providing a support for the base when the closure is in use:

(b) a substantially vertical wall extending upward from an inner periphery of the base having an elevated planar platform over the part of the area encircled by said vertical wall;

(c) a second, higher platform over the remainder of the area enclosed within said vertical wall, there being an integral straight vertical step connecting the upper and lower platforms, said step being in the location of a chord of the circle defined by the base but elevated above the base, the lower elevated platform being larger than the higher platform but both having their upper surfaces parallel with the base and with each other;

(d) a flap joined to the upper edge of said step by an integral hinge forming connection, said flap being movable between an open position where it is clear of the lower elevated position to a closed position where it makes face-to-face contact with the lower elevated platform with which it is substantially coextensive, the flap having a thickness that, when it is closed, its upper surface is a planar extension of said higher elevated platform;

(e) said lower elevated platform having at least one product discharge opening therethrough located in said platform, in an area removed from the axis about which the flap hinges, the flap having at least one projection on its undersurface positioned to enter and close said at least one opening when the flap is tightly closed;

(f) said flap and higher elevated platform transmitting downward pressure thereon through said vertical wall to the inner periphery of the base;

(g) said flap, when closed, through the higher elevated platform providing a combined load supporting area and pressure transmitting surface entirely through said vertical wall extending from the inner periphery of the base into the base and from the base into the lip of the container.

2. The container closure defined in claim 1 wherein the said flap, when closed, has face-to-face contact with the lower planar platform to reinforce the central area of closure when subjected to downward pressure.

3. The product dispensing closure defined in claim 1 wherein there is a group of closely spaced discharge openings through said lower elevated planar platform, near the edge of said platform removed from said step, the flap having a matching group of projections positioned to each enter one of the product discharge openings and close said openings when the flap is fully closed against said planar lower platform, the grouping of the holes and the respective projections providing for the movement of the projections in a direction nearly perpendicular to the axes of the respective holes.

* * * * *